United States Patent [19]

McIntosh

[11] 3,994,382

[45] Nov. 30, 1976

[54] NON-LINEAR SPRING DESIGN FOR MATRIX TYPE PRINTING

[75] Inventor: Robert A. McIntosh, Nashua, N.H.

[73] Assignee: Centronics Data Computer Corporation, Hudson, N.H.

[22] Filed: June 18, 1975

[21] Appl. No.: 588,017

[52] U.S. Cl. ..... 197/1 R; 335/274

[51] Int. Cl.[2] ..... B41J 3/10

[58] Field of Search ..... 197/1 R; 335/274, 258; 101/93.04, 93.05; 251/129, 139, 141

[56] References Cited

UNITED STATES PATENTS

| | | | |
|---|---|---|---|
| 3,584,575 | 6/1971 | Distl | 197/1 R |
| 3,690,431 | 9/1972 | Howard | 197/1 R |
| 3,729,079 | 4/1973 | Zenner et al. | 101/93.04 X |
| 3,787,791 | 1/1974 | Borger et al. | 335/274 |
| 3,831,729 | 8/1974 | Howard | 197/1 R |

*Primary Examiner*—Ralph T. Rader

[57] ABSTRACT

A non-linear spring design for use in a high speed solenoid assembly especially adapted for use in impact printers of the dot matrix type. The solenoid coil—when energized—drives the solenoid armature and a print wire connected thereto for impact against an inked ribbon and a paper document to form a dot upon the paper document. The armature is initially driven against an initially "weak" spring biasing force of a large beam-radius spring member to facilitate rapid acceleration to impact velocity. The radial beam length of the spring member is continually shortened as the armature is displaced in the activated direction by contact at continuously varying support points on the armature head or flux ring, whereby the normally linear spring develops more force in a non-linear manner for the same displacement. Prior to the print wire striking the inked ribbon or paper document, the non-linear spring exerts a greater spring force upon the armature which spring force serves to limit impact velocity and to return the armature to the nonimpact position at a more rapid rate when the solenoid coil is deenergized. The design reduces the complexity of an assembly enabling significantly increased printing speeds by reduction of the elapsed time between movement of the armature and print wire from the rest position to the impact position and the return time of the armature to the rest position.

14 Claims, 9 Drawing Figures

FIG. 1.
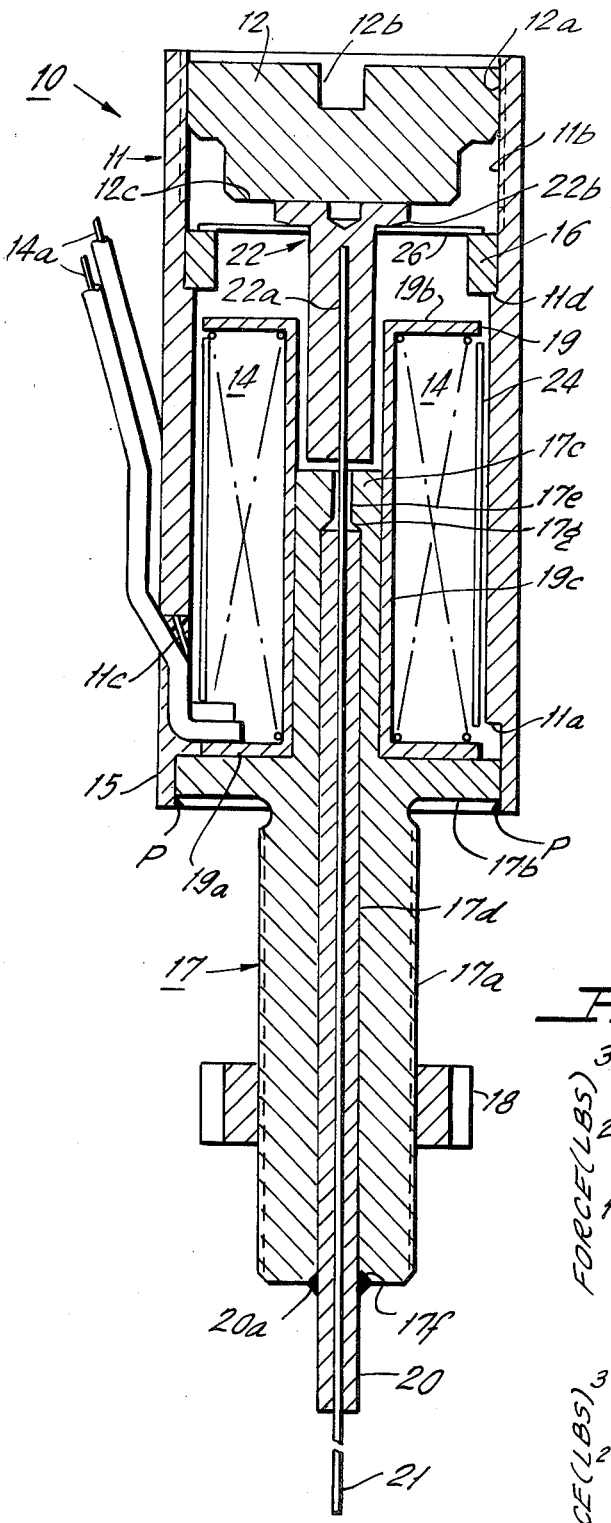
FIG. 2b.
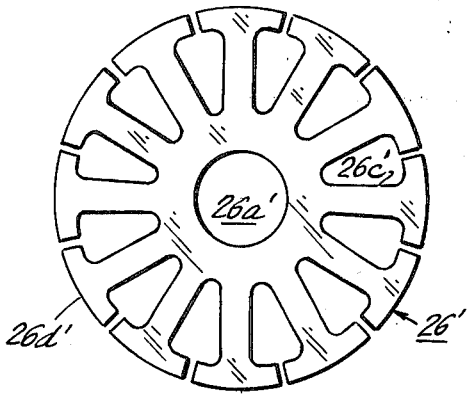
FIG. 2a.
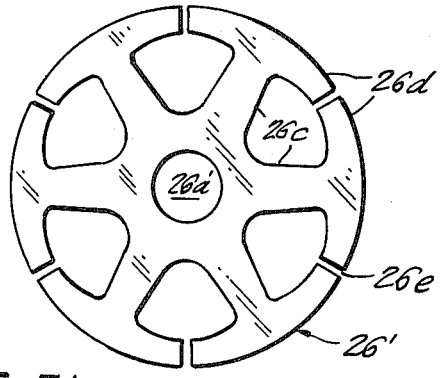
FIG. 3b.
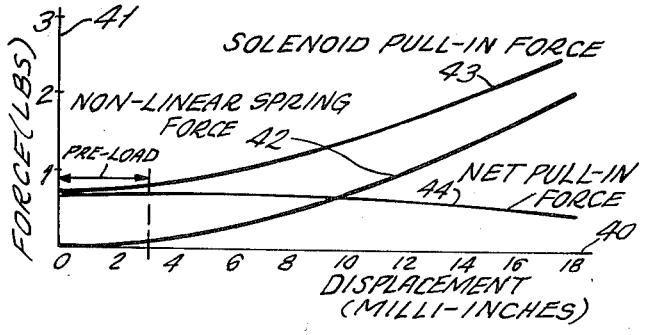
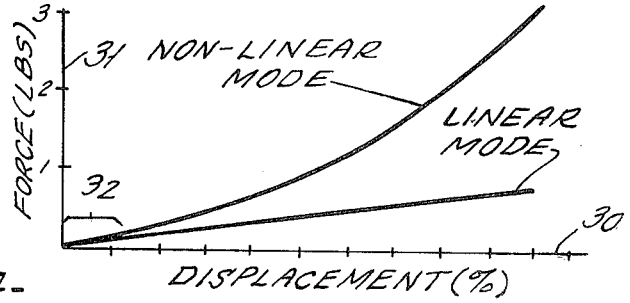
FIG. 3a.

NON-LINEAR SPRING DESIGN FOR MATRIX TYPE PRINTING

BACKGROUND OF THE INVENTION

The present invention relates to impact printers and more particularly to a novel design for obtaining a non-linear spring force which is advantageous for use in matrix type printing solenoids.

Dot matrix printers are typically comprised of a plurality of solenoid driven print wires mounted within a movable print head assembly which traverses an impression material such as a paper document. During movement of the print head across the paper document, solenoids are selectively energized to drive their associated print wires either against an inked ribbon and ultimately against the paper document or directly against the paper document, to form dot column patterns at closely spaced intervals along the printing line. In a typical dot-matrix printer, a 5 × 7 dot matrix is formed for each character by a print head using a substantiallly vertical row of 7 solenoid driven print wires, which print row successively forms 5 dot columns to collectively form a single character symbol or segmented pattern. Selective energization of the solenoids permits alphabetic and numeric characters, punctuation symbols, segmented patterns, and the like to be generated.

In order to achieve high printing speeds, the print wire must be accelerated from a rest position to a velocity sufficiently high to form a high-contrast dot on the original document and, typically, five carbon copies, and return to its original rest position in a total elapsed time less than one millisecond. It is impractical to obtain faster operating speeds using present day conventional solenoid designs. Significantly faster operating speeds have been obtained using a solenoid design, such as described in U.S. Patent Application Ser. No. 499,632, filed on Aug. 22, 1974, and assigned to the assignee of the present invention, in which a case houses an annular-shaped solenoid coil having a hollow core and a cylindrically-shaped magnetic armature with its rearward portion positioned within the hollow core of the solenoid winding and a slender reciprocating print wire attached to its frontward position and extending through an elongated axial opening in the solenoid coil. The rear end of the armature extends beyond the rearward end of the solenoid winding and terminates in a headed portion selectively abutting two or more linear springs. The outer periphery of each linear spring rests upon a surface of an annular-shaped ring assembly shaped in a stepped arrangement such that upon energization of the solenoid coil the armature is accelerated towards impact velocity rapidly overcoming the biasing force of the first spring (of light spring force) and causing a second spring (of greater spring force) to engage a lower step after significant axial movement of the print wire assembly in the print direction, whereby the armature rapidly returns to the rest position after deenergization of the solenoid. While this design reduces the elapsed time between acceleration of the armature from the rest position to the time when the armature returns to the rest position by approximately one-half the elapsed time found in a single spring solenoid assembly, the requirements for multiple spring members and their precise alignment and attachment to the armature header lead to greater manufacturing and assembly time and costs therefor.

BRIEF DESCRIPTION OF THE INVENTION

It is desired to utilize a single linear spring member attached to the armature headed in a manner to provide a non-linear spring force for increasing print wire operating speeds while maintaining a device configuration providing ease of manufacture at low assembly costs.

In accordance with the invention, a non-linear spring force for matrix type printing solenoids is obtained through a design comprising a spring member having a substantially linear spring constant. The spring engages the headed portion of an armature and has an initial radial beam length which extends between the headed portion of the armature and an annular-shaped support ring. The headed portion of the armature which engages the spring is provided with a predetermined curvature to continuously decrease the radial beam length of the spring member between the point at which the spring member engages the armature headed portion and the annular ring inner peripheral edge. As the armature is displaced in the impact direction, the beam length of the spring member decreases through contact with different support points along the radius of curvature of the header surface to continuously increase the return force beyond that obtained for the same displacement relative to the original design which led to the present invention.

In a second embodiment of the present invention, the inner periphery of the support ring has a curved portion for providing the same non-linear increase in spring return force as is developed by the headed armature assembly.

Accordingly, it is one object of the present invention to provide a novel arrangement for obtaining a non-linear spring force which is advantageous for use in matrix type printing solenoids and the like.

It is another object of the present invention to provide such a novel non-linear spring force utilizing a single spring member having essentially a linear spring constant.

It is still another object to provide such a novel non-linear spring force for use in impact printers of the dot matrix type to effectively increase solenoid operating speeds and hence effectively increase printing speeds.

It is a further object to provide a non-linear spring force for dot matrix type printing solenoid assemblies in which the biasing forces are uniformly imposed upon the armature assembly to increase both acceleration and return rates of the solenoid armature.

The above as well as other objects of the present invention will become apparent when reading the accompanying description of the drawings.

DESCRIPTION OF THE DRAWINGS

FIG. 1 is a sectional view of a solenoid assembly in accordance with the present invention;

FIGS. 2*a* and 2*b* are plan views of two "wagon-wheel" type springs, employed to great advantage in the solenoid assembly of FIG. 1;

FIGS. 3*a* and 3*b* are graphs showing curves relating force to deflection distance and useful in describing the operation of the present invention;

DETAILED DESCRIPTION OF THE INVENTION

Figure 1A:
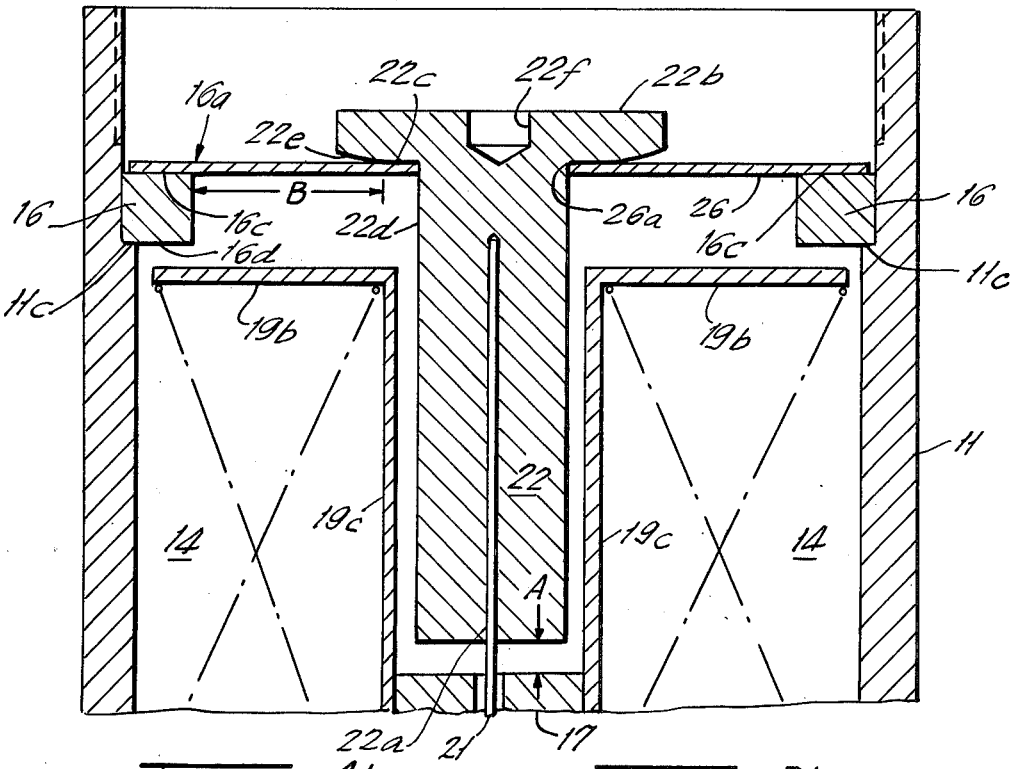
FIG. 1*a* is an enlarged detailed view of the armature and non-linear spring assembly of FIG. 1.
Figure 1B:
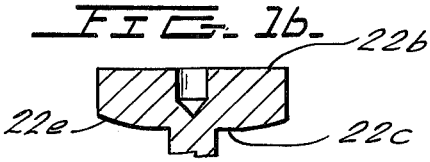
FIG. 1*b* is a sectional view of a headed armature of the type shown in FIG. 1*a;*

Referring initially to FIGS. 1, 1*a* and 1*b*, a solenoid assembly 10 having a hollow cylindrical-shaped case 11 is provided with a recessed shoulder 11a inwardly spaced from the leftmost end of the case. The interior rearward end of case 11 includes a tapped portion 11*b* threadably engaging a threaded portion 12*a* of end cap 12. A portion of case 11 includes an opening 11*c* for the connecting insulated leads 14*a* of solenoid coil 14. After assembly, opening 11*c* is filled with a suitable epoxy 15. Case 11 includes an internal shoulder 11*d* in the interior wall surface thereof, situated in the region between the rearward end of solenoid coil 14 and the inner end surface of end cap 12, to support a flux ring 16, whose design and function will be more fully described hereinafter.

A core stem 17 has an elongated threaded portion 17*a* which is threadably engaged by a lock nut 18 which is adapted for threadable engagement within a tapped aperture entered in the rear wall of a print head housing, as shown, for example, in FIG. 3 of U.S. Pat. No. 3,690,431, issued Sept. 12, 1972, and assigned to the assignee of the present invention. When core stem 17 is properly adjusted into the tapped aperture of such a print head housing, lock nut 18 is firmly tightened against the housing rear wall surface to secure the entire solenoid assembly 10 in position. Annular-shaped flange 17b transversely extends from an intermediate portion of core stem 17 and rests against the forward end of a circular shaped flange 19*a* forming a part of solenoid bobbin 19. After assembly and adjustment of the above-described elements of the solenoid assembly, core stem flange 17*b* is fastened to case 11 by suitable means, such as by spot weld or application of a suitable epoxy-type glue at points P. The rearward portion 17*c* of core stem 17 extends into the hollow core in bobbin 19. Core stem 17 is further provided with an axially aligned elongated opening comprised of a first portion 17*d* of increased diameter which communicates with an opening portion 17*e* of reduced diameter. A tapering portion 17*f* in the front face of core stem 17 facilitates the insertion of a hollow tubular elongated non-magnetic wire tube guide 20 having its leftmost end terminated at a tapering shoulder 17*g* between the elongated openings 17*d* and 17*c*. Tube guide 20 is fastened to core stem 17 by suitable means, such as epoxy or weldments provided at 20*a*. The interior surface of tube guide 17 is preferably coated with a dry lubricant to minimize wearing of an elongated substantially cylindrical-shaped flexible metallic print wire 21 having high compressive and hardness strength and durability. Print wire 21 is slidably engaged by the interior surface of tube guide 20, extends through narrow diameter opening 17*e*, and extends rearwardly therefrom so as to be positioned and secured by soldering or other suitable means within an opening 22*a* in armature 22. The forward or impact end of print wire 21 is adapted to be impacted against an inked ribbon and paper document typically supported by a platen (not shown) to form a "dot" upon the paper document.

Solenoid coil 14 is a hollow elongated coil wound on cylindrical core 19*a* of hollow bobbin 19 and has its opposite ends extended between and confined by bobbin flanges 19*a* and 19*b*. Connecting leads 14*a* extend through passageway 11*c* to facilitate electrical connection to a solenoid driver circuit such as is shown, for example, in FIG. 4 of the above-mentioned U.S. Pat. No. 3,690,431. Insulating tape 24 is wrapped around the cylindrical periphery of coil 14. The rear end of armature 22 is provided with a radially extending cylindrically shaped headed portion 22*b* having a flat annular portion 22*c* perpendicular to cylindrical shaped portion 22*d* of armature 22 to abut the marginal portion of spring member 26 surrounding opening 26*a* (note especially FIG. 1*a*). The curved surface portion 22*e* of armature 22 gradually extends outwardly away from annular portion 22*c* and spring member 26.

FIG. 2*a* illustrates one embodiment of a spring 26' having a central opening 26*a'* through which cylindrical armature shaft 22*d* extends. Spring member 26' has a plurality of spoke beams 26*c* which extend radially outward from the center of the spring and have tapering sides whose width narrows towards the free ends thereof. The free ends are each provided with an arcuate shaped portion 26*d* extending on opposite sides of each spoked portion and spaced from adjacent arcuate shaped portions by a narrow gap 26*e* to permit flexure of beams 26*c*. Arcuate portions 26*d* rest upon surface 16*c* of flux ring 16 (see FIG. 1*a*). It should be understood that the number, length, width, taper and thickness of spoke beams 26*c'* and arcuate portions 26*d'* (as seen in FIG. 2*b*) may be adjusted to derive a desired spring constant.

Flux ring 16 and armature 22 (FIG. 1*a*) are preferably formed of a high permeability ferro-magnetic material, such as silicon iron, to aid in directing magnetic flux through armature 22, as will be more fully described hereinafter. The surface 16*d* of flux ring 16 rests upon case shoulder 11*d* and the outer marginal periphery of spring member 26 bears upon the surface 16*c* of flux ring 16.

End cap 12 is provided with a square-shaped groove 12*b* aligned along one diameter thereof for receiving an adjustment tool such as, for example, the head of a screw driver, for adjusting the end cap to preload armature spring 26 to a desired amount. Armature 22 is hence moved either rearwadly or forwardly (as best seen in FIG. 1) by appropriate adjustment of end cap 12 so as to flex spring 26 and hence adjust the preloading of the armature spring. After end cap 12 and armature 22 are adjusted for both preloading and positioning relative to the rightmost end of core stem 17, end cap 12 is secured in position by depositing a suitable epoxy or other suitable adhesive, such as silicone, rubber or the like, against the interior of surface portions of case 11 adjacent the diametric ends of slot 12*b*.

In operation, solenoid coil 14 is initially de-energized and armature 22 is at its rest position abutting end cap surface 12*c*. In this position spring 26 is slightly flexed.

Upon energization of solenoid coil 14, a magnetic field is generated and concentrated in a magnetic path including core stem portion 17*c*, flange 17*b*, casing 11 (which is preferably of silicon iron), flux ring 16, armature 22 and the gap A between core stem 17 and armature 22. The magnetic field causes the armature to move forward against the return force of spring 26. Spring 26 continues to flex responsive to continuing forward movement of rapidly accelerating armature 22 towards the desire impact velocity.

Initially, the radial beam length B extends from the radially outermost attachment point of spring 26 at armature annular portion 22*c* to the radially innermost corner 16*a* of flux ring 16. As armature 22 moves in a downward direction (FIG. 1*a*), radial beam length B is maintained essentially constant for the initial movement distance of armature 22; the only biasing force initially imparted to armature 22 is the "weak" spring constant biasing force of spring 26, thereby allowing the magnetic field to rapidly overcome the inertia of the mass of armature 22 and initially rapidly accelerate armature 22 towards impact velocity.

As armature 22 continues to move in the impact direction, one support point for spring 26 remains at radially innermost flux ring corner 16*a*, while the other support point is gradually transferred onto armature arcuate portion 22*b* as spring 26 continues to flex downwardly. Radial beam length B is thus continually shortened, resulting in a continually "stronger" spring constant which applies a gradually increasing biasing force against the continued downward motion of armature 22.

Referring now to FIG. 3*a*, where displacement of armature 22 is plotted along abscissa 30 in percent total travel displacement and resulting spring force is plotted along ordinate 31, it can be seen that the force required to move armature 22 over the initial 10% of its total travel displacement remains substantially the same for spring member 26 in its linear or non-linear mode. Thus, armature 22 achieves a substantial velocity before arcuate armature portion 22*e* bears upon a different contact point on spring 26, shortening the radial beam length and causing linear spring 26 to develop more force for the same displacement in a non-linear manner. Armature 22 achieves a sufficient velocity to cause the leftmost end of print wire 21 to impact the inked ribbon and paper document; as armature 22 travels downwardly the last few milli-inches prior to impacting against the ribbon and document, the spring biasing force rapidly increases and serves to store energy for a rapid return of the armature.

Referring to FIG. 3*b*, where actual armature displacement in milli-inches is plotted along abscissa 40 and resulting pounds of force is plotted along ordinate 41, it will be seen that the non-linear spring force curve 42 closely follows the solenoid pull-in force curve 43, to yield a substantially linear net pull-in force curve 44 for the preloaded solenoid assembly, even while the realized return force is increased over those obtained with a linear-mode spring.

Solenoid coil 14 is energized by a square-wave drive pulse of approximately 325 micro-second duration. The print wire impacts the paper document approximately 425 micro-seconds after the first application of the drive pulse. Thus, the solenoid coil drive pulse is terminated approximately 100 micro-seconds before the print wire impacts against the ribbon and document; during this 100 micro-second period the inertia of armature 22 is influenced by the spring biasing force, which force is now considerably greater than the force of a linear spring of equal initial radius, and the bending of the print wire in the head housing assembly. The significantly larger spring force operates on armature 22 to absorb some of the impact force and to rapidly return the armature 22 and hence print wire 21 toward the rest position, typically requiring a time interval of the order of 250 microseconds to return the armature to the rest position.

A central opening 22*f* in the rightmost face of armature 22 cooperates with end cap surface 12*c* to create a "dash-pot" effect to significantly attenuate armature bounce and more rapidly bring the armature to its rest position while greatly reducing wearing of end cap surface 12*c*, thereby maintaining the desired air gap A between armature 22 and core stem 17.

Figure 4A:
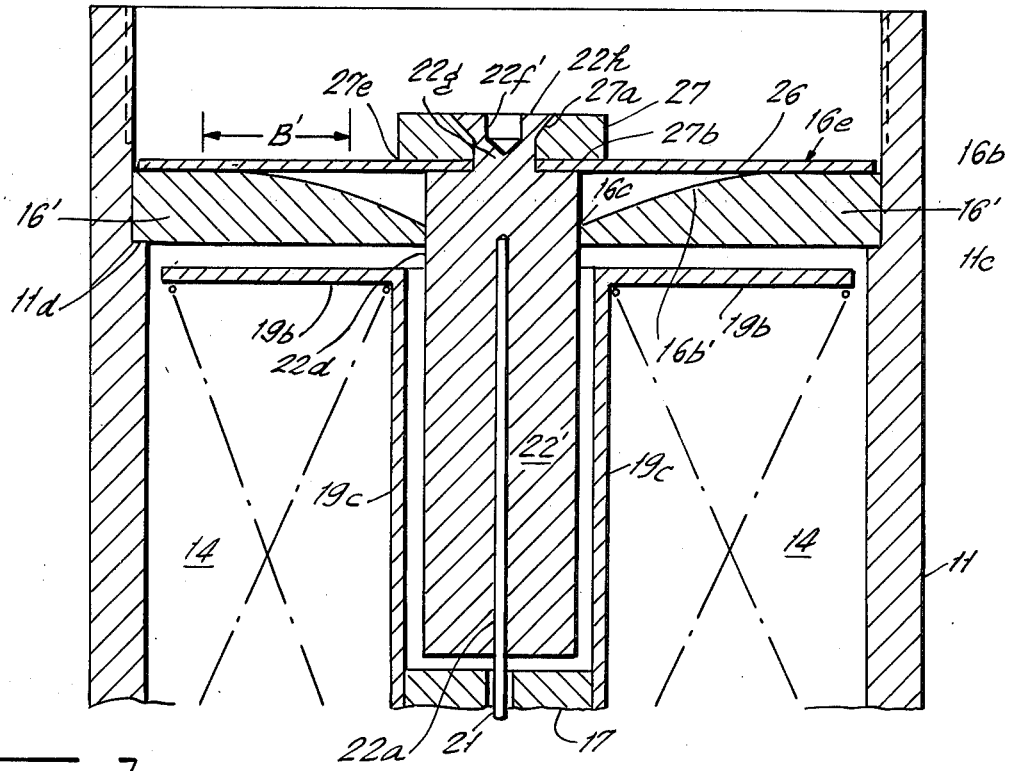
FIG. 4*a* is an enlarged detailed view of a second embodiment of armature and non-linear spring assembly in accordance with the principles of the invention.
Figure 4B:
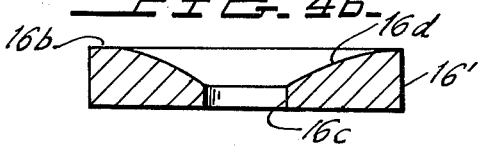
FIG. 4*b* is a sectional view of a flux ring of the type shown in the armature and non-linear spring assembly of FIG. 4*a*.

FIGS. 4*a* and 4*b* show another preferred embodiment of the present invention, wherein like elements of the solenoid assembly are designated by like numerals. The embodiment of FIG. 4*a* differs from that of FIG. 1*a* in that the rear surface of armature 22' is provided with a rearwardly extending cylindrically shaped portion 22*g* which facilitates the insertion of cylindrical projection 22*g* through the central shaped opening 26*a* in spring 26 and thence through a central opening in a ring-shaped metallic spring retainer 27. Cylindrical projection 22*g* is then swaged to form flared portion 22*h* which bears against spring retainer bevelled surface 27*a* to retain spring 26 and spring retainer 27 to armature 22'. One surface of flux ring 16' is provided with a flat portion 16*b* radially outermost from a central aperture 16*c* and a curved portion 16*b* gradually curving frontward and inward towards central aperture 16*c*.

The operation of the alternative embodiment of FIG. 4*a* is substantially similar to that of the embodiment of FIG. 1*a*, wherein the radial beam length B' of spring 26 extends from the radially outermost spring retainer forward periphery 27*c* as a first bearing point to a radially innermost flux ring annular line 16*e* as a second bearing point. Upon energization of solenoid coil 14, the magnetic flux set up by the coil rapidly overcomes the low biasing force exerted by "weak" spring constant spring 26 to rapidly accelerate armature 22' towards impact velocity. After armature 22' has undergone significant acceleration towards its impact velocity, spring 26 has been slightly deflected in the downward direction. Radial beam length B' is still essentially equal to the original radial beam length, as the downward motion of armature 22' causes contact point 16*e* to shift only slightly radially inward onto gently curved arcuate portion 16*d* of flux ring 16'. Thus, over the initial 10 to 15% of the total downward travel of armature 22' the radial beam length B' is not significantly shortened to result in a force-displacement curve having an essentially linear initial portion 32 (see FIG. 3). As armature 22' continues in the downward direction the surface of spring 26 abuts the curved portion 16*b* of arcuate flux ring 16 whereby the radial beam length of spring 26 is continuously shortened to increase the initially "weak" spring constant in a non-linear manner, until the rapidly increasing spring biasing force developed during the later portion of armature 22' downward travel serves to absorb some of the impact shock and to cause armature 22' to rapidly return to the rest position upon the deenergization of coil 14. Opening 22*f'* in the rearward face of cylindrical extension 22*g* cooperates with end cap surface 12*c* to provide the aforedescribed "dash-pot" effect to reduce armature bounce and more rapidly bring the armature to the rest position.

It should be understood that both the radius and center of curvature for arcuate portion 16*d* of flux ring 16', or for arcuate portion 22*e* of headed armature 22, as well as the initial radial beam length B or B' of spring 26 may be coordinately selected to yield a desired non-linear force-distance curve for the spring constant of spring 26.

There has just been described apparatus for obtaining a non-linear spring force advantageous for use in a high speed solenoid assembly allowing an initially linear spring member having a "weak" spring constant to develop additional force for increasing the spring in a non-linear manner, thereby significantly increasing print wire operating speeds while utilizing a single spring member to provide ease of manufacture at low assembly costs.

While several preferred embodiments of this novel invention have been described, many variations and modifications will now be apparent to those skilled in the art. Therefore, this invention is to be limited not by the specific disclosure herein but only by the appended claims.

What is claimed is:

1. Means for developing a non-linear spring force for use in a solenoid assembly employed in dot matrix printers, said solenoid assembly having armature means, coil means for driving said armature means from a rest position to an impact position, and a print wire having a first end attached to said armature means and a second end extending outwardly from said solenoid assembly for impacting a paper document, said assembly further comprising;

a substantially flat spring member having a predetermined initially "weak" spring force constant;

said spring member abutting said armature means at a first location, said initially "weak" spring force initially lightly biasing said armature means and maintaining the armature means in said rest position when said driving means is de-energized;

stationary bearing means surrounding said armature means for supporting said spring member at a second location near the periphery thereof a predetermined initial spaced distance from said first location when said armature means is in the rest position;

said armature means including curvilinear surface means engaged by said spring member at decreasingly smaller distances from said second location as the spring member flexes responsive to said armature means moving from said rest position to said impact position due to energization of said driving means, whereby the force exerted by said spring member upon said armature means increases in a non-linear manner to thereby facilitate rapid initial acceleration of said armature means against said initially "weak" spring force and rapid return of said armature means to the rest position upon de-energization of said driving means.

2. An assembly as set forth in claim 1, wherein said curvilinear means includes a portion of said armature means having a headed end provided with a curved convex surface positioned adjacent said spring member for engaging the confronting surface of said spring member progressively closer to said second location as said armature means moves in the impact direction.

3. An assembly as set forth in claim 2, wherein said predetermined surface curve facilitates the development of a predetermined non-linear rate of change of spring force with respect to the instantaneous position of said armature means.

4. An assembly as set forth in claims 3, wherein said curved shape affects the rate of change of spring force to be greatest when said armature means is adjacent said impact position.

5. An assembly as set forth in claim 1, wherein said spring member is formed of a ferromagnetic material to enhance the magnetic circuit and hence the pulling effect of the solenoid assembly upon the armature.

6. An assembly as set forth in claim 1, wherein said bearing means is formed of a ferromagnetic material to enhance the magnetic circuit and hence the pulling effect of the solenoid assembly upon the armature.

7. An assembly as set forth in claim 1, wherein said armature means comprises a cylindrical body having an enlarged header portion at one end; said spring member having a central opening for receiving said cylindrical body; adjustable means contacting an end of said header portion opposite that portion engaged by said spring member for positioning said armature means at said rest position, whereby said spring member is preloaded and thereby flexed to maintain said header portion adjustable and in abutting engagement with both said adjustable means and said spring means when the armature means is in the rest position.

8. Means for developing a non-linear spring force for use in a solenoid assembly employed in dot matrix printers, said solenoid assembly having armature means, coil means for driving said armature means from a rest position to an impact position, and a print wire having a first end attached to said armature means and a second end extending outwardly from said solenoid assembly for impacting a paper document, said assembly further comprising:

a substantially flat spring member having a predetermined initially "weak" spring force constant;

said spring member abutting said armature means at a first location, said initially "weak" spring force initially lightly biasing said armature means and maintaining the armature means in said rest position when said driving means is de-energized;

stationary bearing means surrounding said armature means for supporting said spring member at a second location near the periphery thereof a predetermined initial spaced distance from said first location when said armature means is in the rest position;

said bearing means including curvilinear surface means engaged by said spring member at decreasingly smaller distances from said second location as the spring member flexes responsive to said armature means moving from said rest position to said impact position due to energization of said driving means, whereby the force exerted by said spring member upon said armature means increases in a non-linear manner to thereby facilitate rapid initial acceleration of said armature means against said initially "weak" spring force and rapid return of said armature means to the rest position upon de-energization of said driving means.

9. An assembly as set forth in claim 8, wherein said curvilinear means includes a portion of said bearing means adjacent said second location having a curved convex surface adjacent the confronting surface of said spring member for engaging said spring member progressively closer to said first location as the armature means moves towards the impact position.

10. An assembly as set forth in claim 9, wherein said predetermined curved surface facilitates the development of a predetermined non-linear rate of spring force change with respect to the instantaneous position of said armature means.

11. An assembly as set forth in claim 10, wherein said curved shape is adapted to control the rate of change of spring force to be greatest when said armature means is adjacent to said impact position.

12. An assembly as set forth in claim 8, wherein said curved means comprises an annular ring, a portion of said annular ring having a curved surface adjacent to and engaged by said spring member for engaging said spring member first surface progressively closer to said abutment junction as the armature means moves toward the impact position.

13. An assembly as set forth in claim 8, wherein said curvilinear means includes the end of said header portion joined to said shaft portion having a convex curved surface adjacent said abutment junction for causing said spring member second surface to engage the curved surface at locations progressively closer to said annular ring abutment surface as the armature means moves toward the impact position.

14. A solenoid assembly for use in a dot matrix printer and having armature means and a print wire having a first end attached to said armature means and a second end outwardly extended from said solenoid assembly for impacting a paper document, said assembly further comprising:

solenoid means for displacing said armature means from a rest position and imparting a first force upon the armature means which varies non-linearly with displacement of the armature means from the rest position when the solenoid means is energized;

spring means engaging said armature means;

means displaced from said armature means and having curvilinear means for engaging the spring means and cooperating with said spring means for causing said spring means to exert a second force upon the armature means, which second force varies non-linearly with displacement of the armature means when the solenoid means is energized, the non-linearity of the first and second forces being substantially similar to one another, whereby the resultant force exerted upon said armature means is substantially linear and said spring engaging means causes said armature means to rapidly accelerate when said solenoid means is energized and rapidly return to said rest position when said solenoid means is de-energized.

* * * * *